United States Patent [19]

Stearns

[11] 4,319,403

[45] Mar. 16, 1982

[54] POWER DRILL POSITION INDICATOR

[76] Inventor: Eugene R. Stearns, 3480 SW. Western Blvd., Corvallis, Oreg. 97330

[21] Appl. No.: 192,177

[22] Filed: Sep. 29, 1980

[51] Int. Cl.[3] ..... B27G 23/00

[52] U.S. Cl. ..... 33/185 R; 408/112; 408/16

[58] Field of Search ..... 33/180 R, 185 R, 1 N, 33/172 B, 172 E; 408/112, 115 R, 241 R, 241 G, 75, 16

[56] References Cited

U.S. PATENT DOCUMENTS 3,242,773 3/1966 van Praag ..... 408/112 X
3,707,043 12/1972 Jones ..... 33/185 R
3,746,460 7/1973 Lipe ..... 408/112
4,227,839 10/1980 Conway ..... 408/112 X

*Primary Examiner*—Harry N. Haroian
*Attorney, Agent, or Firm*—James D. Givnan, Jr.

[57] ABSTRACT

A device for use in conjunction with a power tool, such as an electric drill, the device including an elongate housing in place on the drill motor housing. The forward end of the housing telescopically supports a carrier within which is universally mounted a foot member. Electrical contacts within the carrier are contactable by the foot member upon the elongate housing inadvertently being out of a desired perpendicular relationship to a work piece surface. An indicator at the rearward end of the elongate housing provides signal lamps indicating to the tool operator which direction the tool must be moved to re-establish the desired tool-to-work piece perpendicular relationship.

10 Claims, 6 Drawing Figures

POWER DRILL POSITION INDICATOR

BACKGROUND OF THE INVENTION

The present invention concerns an indicator device for providing a visual signal to a tool operator to assure the tool operating axis is perpendicular to the surface of a work piece.

In certain types of fabrication work it is desirable that pilot holes for fasteners be formed truly perpendicular or normal through the pieces being joined. Pilot holes inclined to a desired axis incur wasted man hours spent trying to remedy same by re-drilling the work pieces or beveling a shim. Installation of a metal fastener other than in normal disposition to the joined pieces may impart asymetrical loads to the fastener causing premature failure of same.

The problem of boring pilot holes normal to a work piece surface is entirely distinct from boring pilot holes along vertical or horizontal axes. In the prior art are gravity responsive drill attachments such as shown in U.S. Pat. Nos. 4,141,151 and 4,189,726. A pilot bore drilled with such an aid would be perpendicular to the work piece surface only if the surface is truly vertical or horizontal which is seldom the case in certain types of fabrication, e.g., airframe.

SUMMARY OF THE PRESENT INVENTION

The present invention is embodied in a device for indicating to a power tool operator the relationship of the tool's operating axis to an optimum axis perpendicular to the work pieces regardless of whatever position or attitude the work piece or pieces may be in.

The instant device is for use in conjunction with a power tool such as a hand held drill. A foot member of the device is adapted to restingly abut the surface being drilled. Electrical contacts are concentrically disposed so as to come into foot engagement upon the drill moving out of the optimum perpendicular axis. Indicator signal means indicate to the operator which direction the drill must be repositioned to return to the perpendicular. The foot member and its carrier are axially retractable during drilling to provide guidance throughout initial drilling after which the course of the bit is automatically controlled by the bore formed. The indicator signal means are positionable so as to be easily viewed by the operator at various drill locations.

Important objects of the present invention include the provision of a device for use with a power tool having an operating axis at all times desirably perpendicular to the surface of the work piece or pieces being drilled, said device providing to the tool operator a signal when the tool is out of perpendicular and further, what direction the tool must be moved to restore coincidence of the tool operating axis and a desired perpendicular axis; the provision of a device for use by those boring pilot holes in inclined, horizontal or vertical work pieces where it is important that the hole so formed is on an axis normal to work piece surfaces; the provision of a device readily attachable to a power drill with check means provided to assure the work piece engaging foot member of the device is in parallel offset relationship with the tool operating axis.

DETAILED DESCRIPTION OF THE PREFERRED EMBODIMENT

Figures 1, 2, 3, 4, 5, 6:
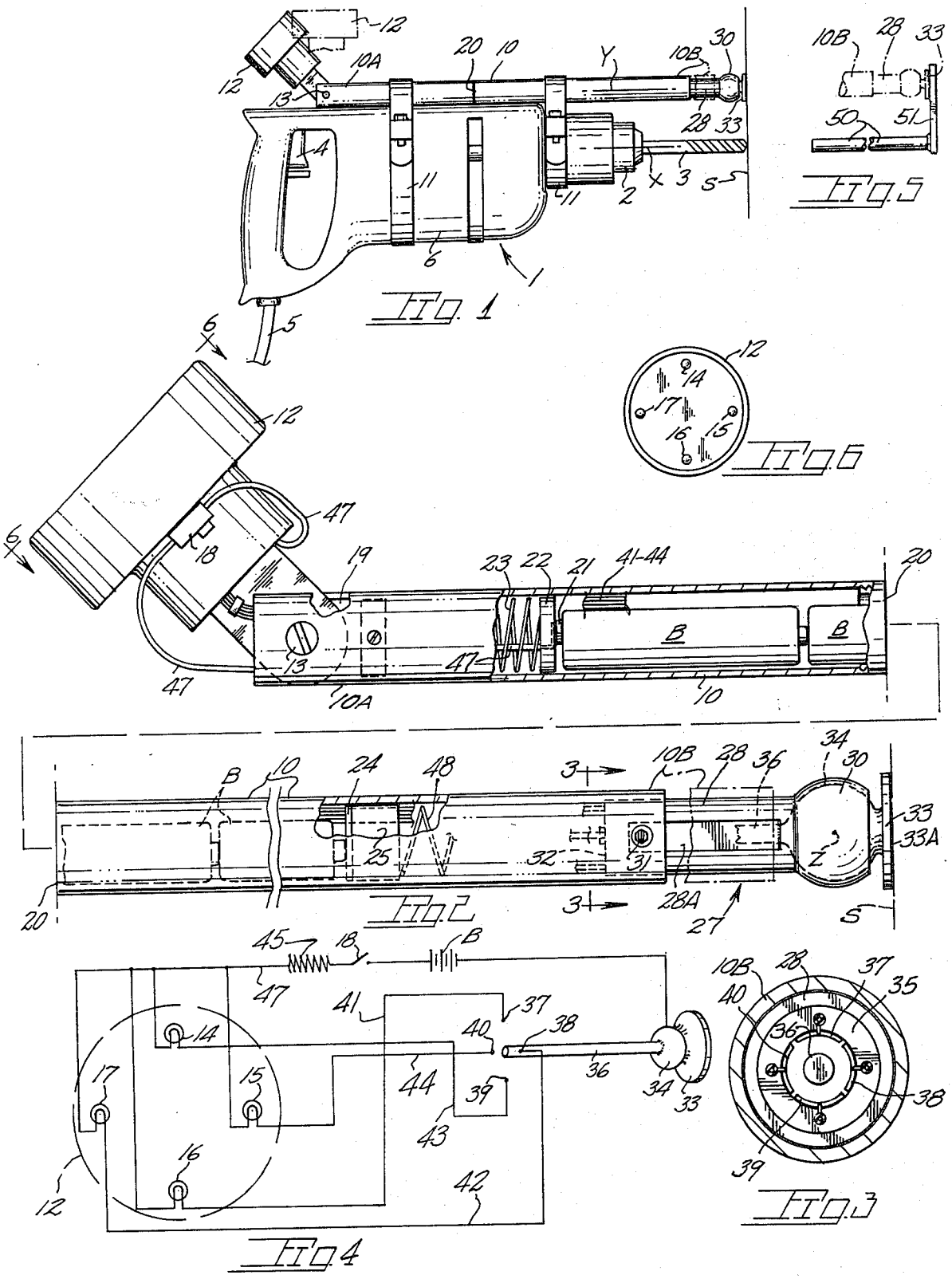
FIG. 1 is a side elevational view of a power drill with the present device thereon.
FIG. 2 is a side elevational view of the present device sectioned for purposes of illustration and shown approximately full scale.
FIG. 3 is a vertical sectional enlarged view taken along line 3—3 of FIG. 2.
FIG. 4 is a wiring schematic.
FIG. 5 is a side elevational view of a chuck mountable aid used for aligning the axis of the present device with the tool operating axis.
FIG. 6 is an elevational view on a reduced scale of signal means of the device taken along line 6—6 of FIG. 2.

With continuing attention to the drawing, the reference numeral 1 indicates generally a hand held power tool shown as an electric drill typically including a chuck 2 within which is received a drill bit 3. The drill includes a finger actuated control 4 which opens and closes associated switch contacts in circuit with an electrical power supply via a cord 5. While a typical power drill is illustrated, it is to be understood that the present device is compatible with power drills of different configuration as well as other drilling or boring devices.

An elongate housing at 10 of the present device is secured in place on a drill motor housing at 6 by mounting means at 11 shown as metal straps of the type incorporating tensioning means. Depending upon the configuration of the motor housing 6, elongate housing 10 may be supported in a manner utilizing shims or the like to assure the major axis Y of housing 10 is parallel to the operating axis X of the power drill. While housing 10 is shown as being cylindrical, that portion abutting drill motor housing 6 may be otherwise configured to enhance secure placement on the motor housing. A rearward end segment 10A of the elongate housing is bifurcated at 19 to support signal means 12 pivotally coupled thereto by a fastener 13 which permits positioning of the signal means for optimum viewing by the drill operator. As shown in FIG. 6, the signal means is provided with lamps which may be light emitting diodes termed LED's at 14, 15, 16 and 17. Additionally, the signal means serves to conventionally mount an OFF-ON control switch 18 in electrical circuit with said diodes and a power source.

The elongate housing of the present device is segmented at 20 to facilitate deposit of a power source such as dry cell batteries at B arranged in series. A ground at 21 is carried by a yieldably mounted support 22 the latter spring biased into battery engagement by a helical spring 23. Shown also in FIG. 2 is a disk-like terminal 24 contacted by the forwardmost battery. A support 25 is fixed within the tubular housing. Terminal 24 is in electrical contact with housing 10.

Indicated generally at 27 is inclination sensing means including a tubular carrier 28 having a spherical forward end 30 shaped to provide a ball socket. Said carrier is adapted for telescopic movement relative the forward end segment 10B of housing 10 with such movement being limited by a stop 31 coacting with a recessed flat area 28A formed on the carrier. A foot member includes a foot 33 with a work piece abutting surface 33A and integral with a spherical component 34, the latter universally supported in the ball socket end 30 of the carrier. Integral with spherical component 34 is an arm 36 which is substantially coterminous with the inner end 32 of carrier 28. As shown in the sectional view of FIG. 3, the inner end of arm 36 is proximate a circular array of electrical contacts 37, 38, 39, 40 in place within a ring 35 of insulative material. Ring 35 and the contacts are held in place within the carrier inner end by a suitable adhesive. In a suitable embodiment of the invention, arm 36 when concentrically disposed within ring 35 (as shown in FIG. 3) has a contact clearance of approximately one-sixteenth of an inch. From the foregoing, it will be seen that upon foot surface 33A being in surfacial abutment with a work piece surface at S, any inclination of housing 10 (and hence carrier 28 therein) from the perpendicular position shown in FIG. 1 will result in the inner end of arm 36 contacting at least one of the contacts 37 through 40.

Biasing tubular carrier 28 outwardly in a forward direction is a helical spring 48 acting on carrier mounted contact supporting ring 35. A fixed spring end is retained by stationary support 25.

In the wiring schematic of FIG. 4, current from the batteries B is applied to arm 36 with metal housing 10 and carrier 28 serving as conductors. Relative axial displacement between arm 36 and carrier 28 will result in arm 36 closing with and imparting current flow to a contact 37, 38, 39 or 40 or to two adjacent contacts to cause illumination of a diode 14, 15, 16 or 17 (or two adjacent diodes) via leads 41, 42, 43 or 44 in circuit respectively with the diodes. A resistor at 45 and OFF-ON control switch at 18 in a ground conductor 47 complete the circuit back to the ground size of batteries B. Leads 41–44 are bundles for convenient lengthwise passage through housing 10.

In the preferred embodiment of the invention above described arm 36 will close with a contact 37–40 upon housing axis Y (and tool operative axis X) being displaced through five degrees or less about a center Z of spherical component 34. With contacts 37–40 in circuit with diodes 14–17 as shown, diode 14 will illuminate to indicate operative axis X of the drill is above optimum axis, illumination of diode 15 indicates axis X of the drill is to the right of the optimum axis, etc., with corrective repositioning of the drill indicated by the diode(s) going out.

For purposes of installation of the present indicator on a power tool and periodic checking of parallel alignment to the tool operative axis, an aid is shown in FIG. 5 including a spindle 50 for chuck installation. A plate 51 is normal to the spindle axis and serves to surfacially receive foot member 33. Elongate housing 10 is then positioned on the power tool and secured in place with attention to assuring the diodes remain unlit to thereby indicate parallel alignment with indicator axis Y and tool operating axis X.

While the indicator disclosed as being separable from the power tool, it is to be understood that the indicator may be a part of or permanently secured to the tool and that a power source for the indicator may utilize a common power source with the tool.

While I have shown but a few embodiments of the invention it will be apparent to those skilled in the art that the invention may be embodied still otherwise without departing from the spirit and scope of the invention.

Having thus described the invention, what is desired to be secured under a Letters Patent is:

I claim:

1. A device for use in indicating the relationship of a power tool operating axis to a desired operating axis perpendicular to a work piece surface, said device comprising, a housing having a forward and a rearward end, means for mounting said housing on the power tool with the housing axis parallel to the tool operating axis, visual signal means in place on said housing and in circuit with an electrical power source, and inclination sensing means at the forward end of said housing and including a foot member for work piece surface abutment, a carrier supported by said housing and supporting said foot member for universal movement, electrical contacts concentrically disposed about the axis of the carrier, each of said contacts in circuit with said visual signal means, said foot member and said electrical contacts operable upon lateral displacement of the carrier relative said foot member to close a circuit through one of said contacts and activate said visual signal means to indicate the direction of tool operating axis displacement to aid in the operator's manual return of the tool operating axis to the desired axis perpendicular to the work piece.

2. The device claimed in claim 1 wherein said carrier is telescopically supported by said elongate housing, resilient means biasing said carrier toward an extended position.

3. The device claimed in claim 1 wherein said visual signal means is movably mounted on said housing.

4. The device claimed in claim 1 wherein said housing is adapted to receive dry cell batteries.

5. The device claimed in claim 1 wherein said visual signal means includes spaced multiple lamps.

6. An indicator device for use in conjunction with a power tool as an aid to maintain the tool in perpendicular relationship to a work piece surface, said device comprising, a housing having a forward end for disposition adjacent the work piece surface, a power source, means mounting said housing to the power tool, visual signal means on said housing and in circuit with the power source, and inclination sensing means carried at the forward end of the housing, said sensing means including a universally mounted foot member and electrical means radially offset from said foot member when said foot member and said housing are perpendicular to the work piece surface, said foot member and said electrical means operable to close and open the electrical circuit serving said visual signal means during relative lateral movement between said foot member and said housing.

7. The device claimed in claim 6 wherein said sensing means includes a carrier telescopically supported by said housing, said foot member and said electrical means disposed on said carrier, resilient means biasing the carrier toward an extended position.

8. The device claimed in claim 7 wherein said visual signal means is adjustably mounted on said housing.

9. The device claimed in claim 8 wherein said housing is of elongate shape to receive batteries constituting the power source.

10. The device claimed in claim 6, 7, 8 or 9 wherein said visual signal means includes spaced lamps, said electrical means comprising a circular array of electrical contacts one each in circuit with one of said lamps.

* * * * *